US006401409B1

(12) United States Patent
Martin

(10) Patent No.: US 6,401,409 B1
(45) Date of Patent: Jun. 11, 2002

(54) UNDERGROUND STORM SHELTER

(76) Inventor: Michael C. Martin, 5527 Stonecliffe Dr., Lincoln, NE (US) 68516

( * ) Notice: Subject to any disclaimer, the term of this patent is extended or adjusted under 35 U.S.C. 154(b) by 146 days.

(21) Appl. No.: 09/085,540

(22) Filed: May 27, 1998

(51) Int. Cl.[7] ..... F02D 29/12

(52) U.S. Cl. ..... 52/169.6; 52/134; 52/170; 52/20; 52/21; 220/4.24; 220/484

(58) Field of Search ..... 52/169.6, 134, 52/170, 20, 21; 220/567.1, 4.04, 4.06, 4.07, 4.26, 4.05, 4.08, 4.21, 4.24, 484, DIG. 1

(56) References Cited

U.S. PATENT DOCUMENTS

| | | | | | |
|---|---|---|---|---|---|
| 4,647 | A | * | 7/1846 | Peebles | 52/169.6 |
| 128,003 | A | * | 6/1872 | Wiley | 220/4.04 |
| 183,575 | A | * | 10/1876 | Kennon | 52/20 |
| 754,801 | A | * | 3/1904 | Pomroy | 52/20 |
| 772,117 | A | * | 10/1904 | Winslow | 52/20 |
| 871,977 | A | * | 11/1907 | Winslow | 52/20 |
| 876,392 | A | * | 1/1908 | Peterson | 52/20 |
| 929,644 | A | * | 7/1909 | Harshbarger | 52/20 |
| 951,192 | A | * | 3/1910 | Massey | 52/169.6 X |
| 991,327 | A | * | 5/1911 | Fave | 220/4.24 |
| 1,170,927 | A | * | 2/1916 | Moore | 220/4.06 |
| 1,281,405 | A | * | 10/1918 | Marquess | 52/20 |
| 1,545,036 | A | * | 7/1925 | Culhane, Jr. et al. | 220/4.06 |
| 1,639,495 | A | * | 8/1927 | Frame | 52/20 |
| 1,712,510 | A | * | 5/1929 | Monie | 52/20 |
| 1,866,979 | A | * | 7/1932 | Lerio | 220/4.24 |
| 2,134,651 | A | * | 10/1938 | Aten | 52/169.6 X |
| 2,346,196 | A | | 4/1944 | Starret | |
| 2,729,966 | A | | 1/1956 | Lutteke | |
| 2,822,765 | A | | 2/1958 | Kudinger | |
| 2,936,504 | A | | 5/1960 | Harris | |
| 3,196,813 | A | | 7/1965 | McHugh, Jr. | |
| 3,404,797 | A | * | 10/1968 | Dolling | 52/169.6 X |
| 3,934,747 | A | * | 1/1976 | Needt | 220/5 R |
| 3,938,285 | A | * | 2/1976 | Gilbu | 52/169.6 X |
| 3,938,687 | A | * | 2/1976 | Maier et al. | 220/5 |
| D242,924 | S | | 1/1977 | McKnight | |
| D261,432 | S | | 10/1981 | Ballard | |
| 4,334,393 | A | | 6/1982 | U'Ren | |
| 4,359,845 | A | | 11/1982 | Harrison | |
| 4,472,911 | A | * | 9/1984 | Jooris et al. | 52/20 |
| 4,534,144 | A | | 8/1985 | Gustafsson et al. | |
| 4,615,158 | A | * | 10/1986 | Thornton | 52/169.6 |
| 4,709,120 | A | | 11/1987 | Pearson | |
| 5,117,593 | A | * | 6/1992 | Tiernan | 52/169.6 X |
| 5,487,604 | A | * | 1/1996 | Moran | 366/225 |
| 5,617,679 | A | * | 4/1997 | Meyers | 52/20 |
| 5,852,901 | A | * | 12/1998 | Meyers | 52/20 |

FOREIGN PATENT DOCUMENTS

| | | | | |
|---|---|---|---|---|
| CH | 457306 | * | 7/1968 | 52/20 |
| DE | 745931 | * | 5/1944 | 52/169.6 |
| JP | 48905 | * | 5/1989 | 52/20 |

* cited by examiner

*Primary Examiner*—Carl D. Friedman
*Assistant Examiner*—Phi Dieu Tran A
(74) *Attorney, Agent, or Firm*—Thomte, Mazour & Niebergall; Dennis L. Thomte

(57) ABSTRACT

An underground storm shelter comprising a bottom section, expander section and a top section bolted together to form the shelter. The base section has a closed bottom while the top section has an access hatch formed in the upper end thereof. The base section, expander section and top section are bolted together at the installation site. The walls of the base section and the top section are tapered to enable the base section and the top section to be nested during shipment. The expander section may be slipped over the top section.

7 Claims, 4 Drawing Sheets

UNDERGROUND STORM SHELTER

BACKGROUND OF THE INVENTION

1. Field of the Invention

This invention relates to a storm shelter and more particularly to an underground storm shelter which is comprised of a base section, an expander section and a top section with the top section having an access hatch therein.

2. Description of the Related Art

Many types of underground storm shelters have been previously provided with some of the shelters being large enough to also serve a double-duty as a bomb shelter. Generally speaking, the prior art bomb shelters were constructed of concrete with the same being cast in place which necessarily involved a large, expensive building project. Additionally, the prior art shelters which were smaller than the typical bomb shelters were normally of a one-piece construction which also made the shelters quite expensive and difficult to install.

SUMMARY OF THE INVENTION

An underground storm shelter is disclosed comprising a base section, one or more expander sections and a top section installed either on the upper end of the base unit or on the upper end of the uppermost expander sections. The base section comprises a bottom wall having an outwardly tapered wall section extending upwardly therefrom with the upper end thereof having a bolt flange provided thereon. Each of the expander sections comprises a cylindrical wall having bolt flanges on the upper and lower ends thereof with the bolt flange on the lower end of the lowermost expander section being adapted to be bolted to the bolt flange on the upper end of the base section. The top section comprises a bolt flange at the lower end thereof with an inwardly tapered wall section extending upwardly therefrom. The upper end of the top section is closed except for an access hatch provided therein. The utilization of one or more expander sections which may be bolted between the base section and the top section enables the shelter to have a depth such as to accommodate persons of varying heights. The tapered wall sections of the base section and the top section enables the base section and top section to be nested together for shipment purposes. Preferably, the storm shelter is comprised of plastic, fiberglass, or fiberglass reinforced concrete.

It is therefore a principal object of the invention to provide an improved underground storm shelter.

Yet another object of the invention is to provide an underground storm shelter which is comprised of a plurality of component parts which enables the storm shelter to be constructed by persons having little or no construction experience.

Still another object of the invention is to provide an underground storm shelter which may be installed in the ground with a minimum of disruption of the area around the storm shelter.

Still another object of the invention is to provide an underground storm shelter which is comprised of a plurality of lightweight component parts.

Still another object of the invention is to provide an underground storm shelter which includes component parts so that the storm shelter may be easily assembled and may accommodate persons of different heights.

These and other objects will be obvious to those skilled in the art.

DESCRIPTION OF THE PREFERRED EMBODIMENT

Figure 1:
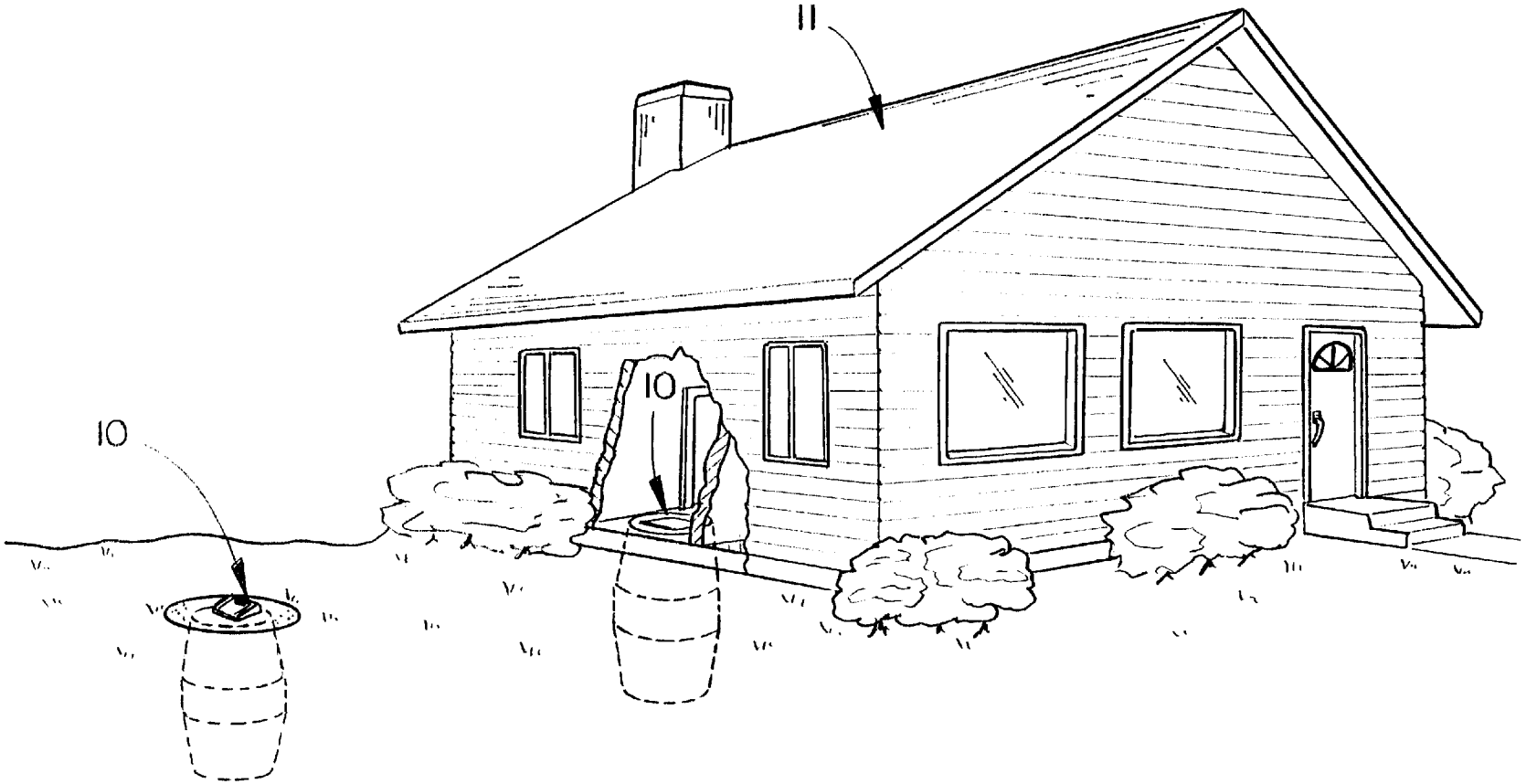
FIG. 1 is a perspective view showing the underground storm shelter of this invention positioned either beneath a home or outside thereof.

The underground storm shelter of this invention is referred to generally by the reference numeral 10 and is designed to be installed in the ground outside of a home 11 or beneath the home 11, as illustrated in FIG. 1. Shelter 10 includes a base section 12, one or more expander sections 14 and a top section 16. Preferably, the base section 12, expander sections 14 and the top section 16 are constructed of a plastic material, fiberglass material, or a fiberglass reinforced concrete material.

Figure 2:
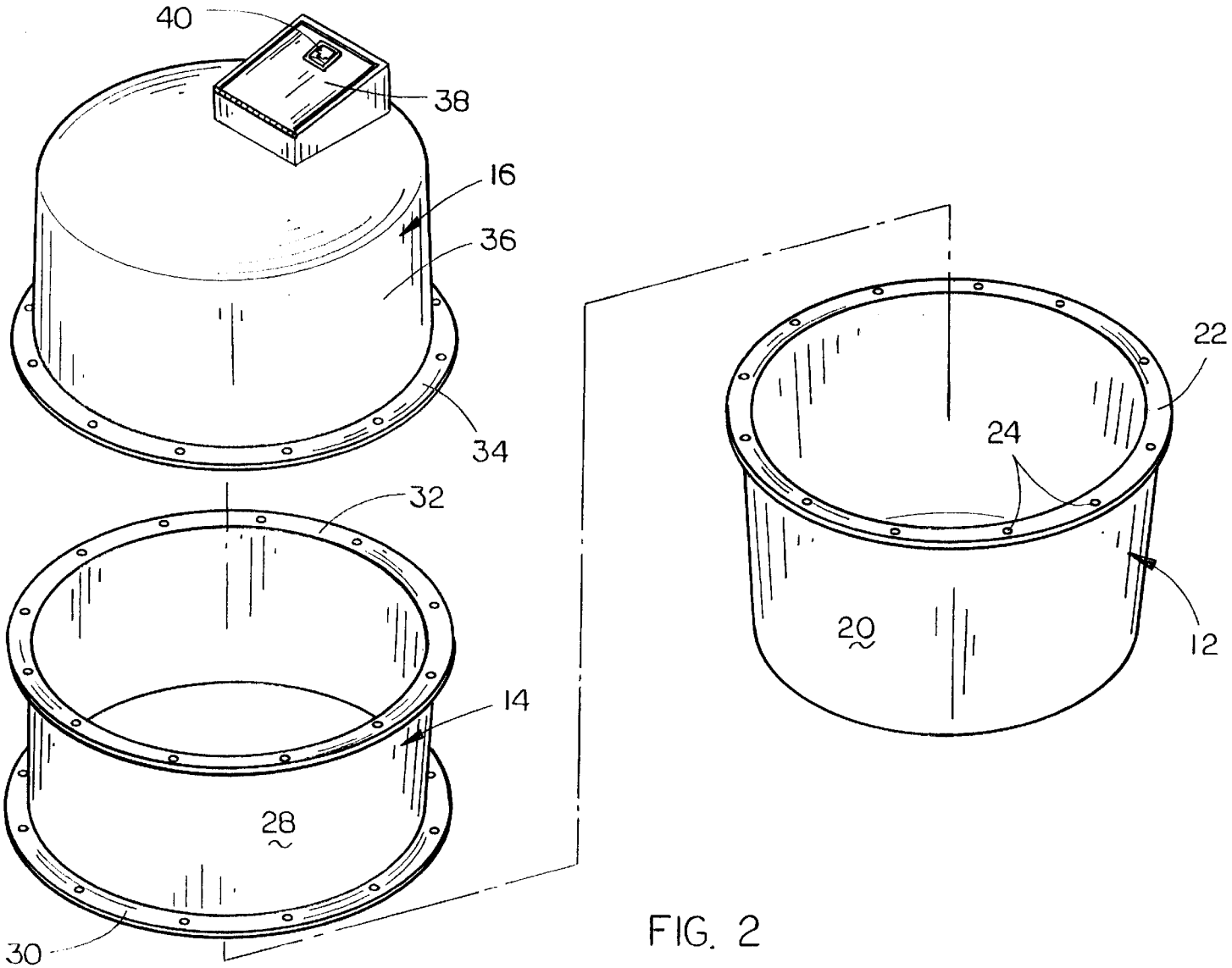
FIG. 2 is an exploded perspective view of the invention.
Figure 4:
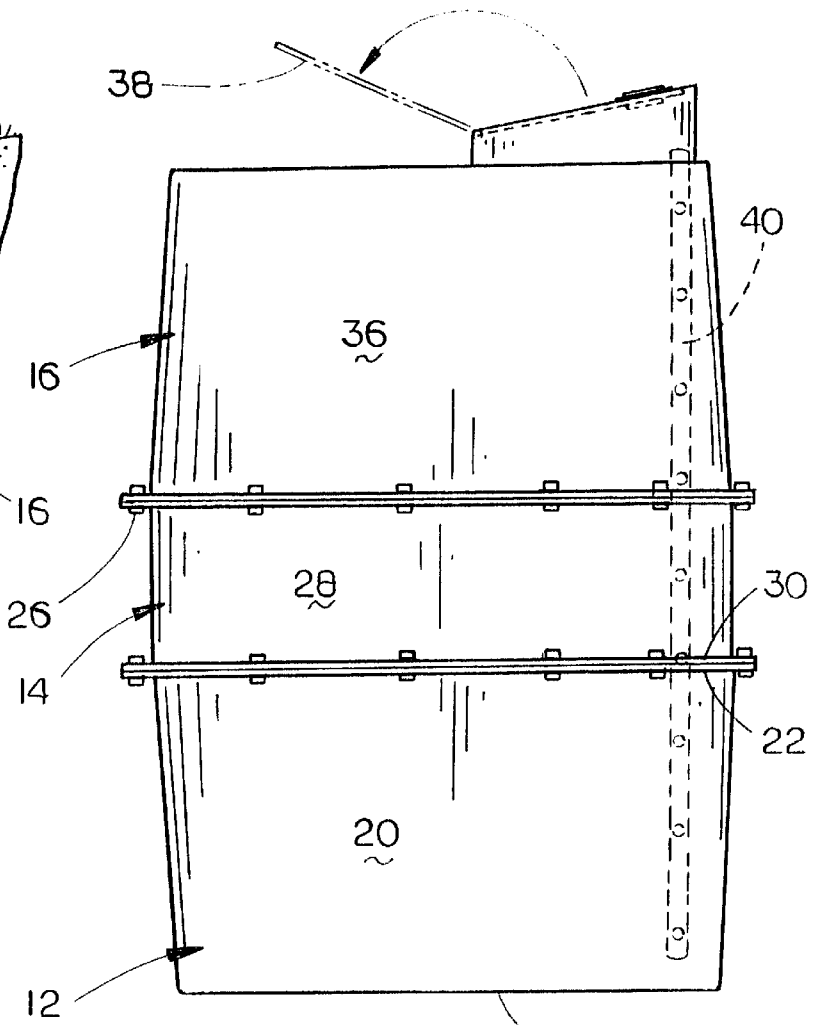
FIG. 4 is a view of the shelter of this invention illustrating an expander unit joining the upper and lower sections.
Figure 3:
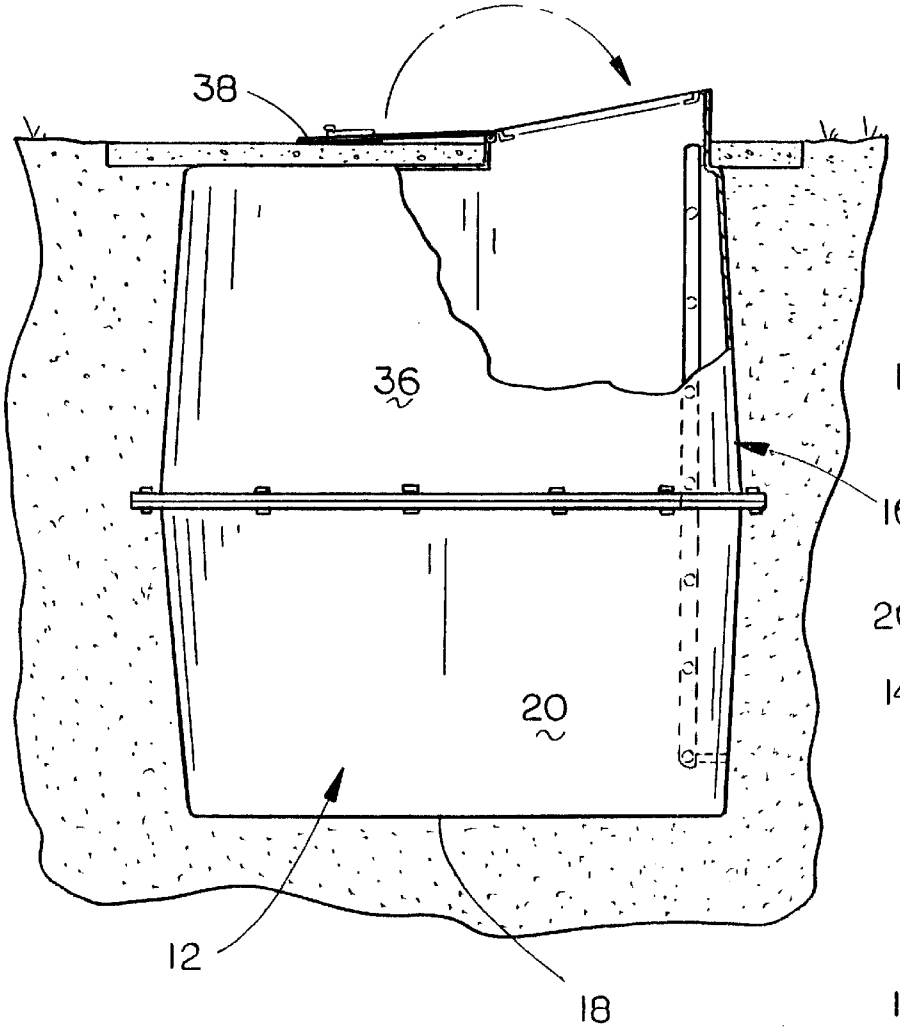
FIG. 3 is a side view illustrating the storm shelter of this invention installed in the ground.
Figure 5:
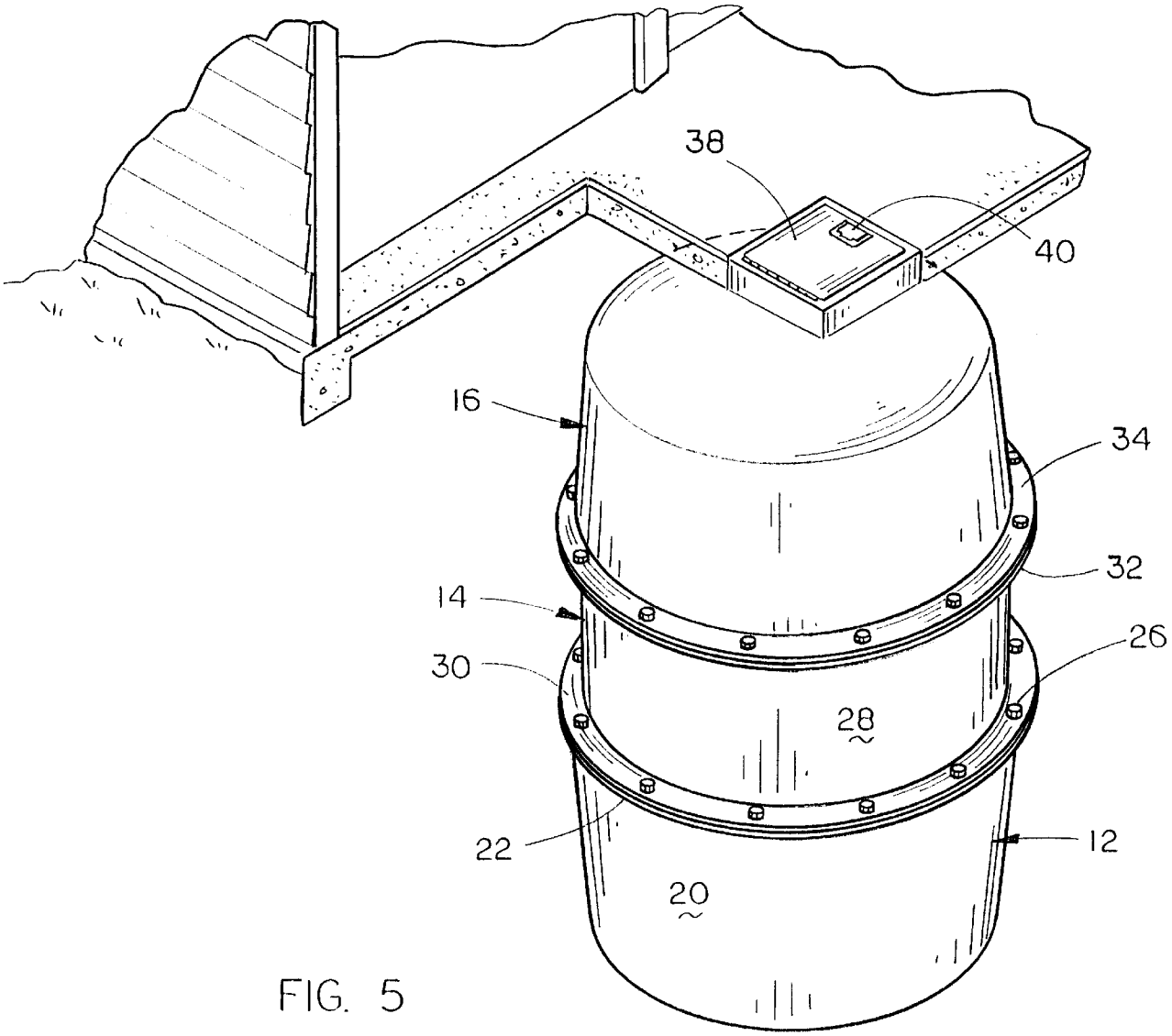
FIG. 5 is a view illustrating the storm shelter of this invention being positioned beneath the slab of a home.

Base section 12 includes a bottom wall 18 having a wall 20 extending upwardly therefrom which preferably tapers outwardly, as illustrated in FIG. 2. A bolt flange 22 is provided at the upper end of wall 20 and has a plurality of openings 24 formed therein adapted to receive bolts 26 therein. Preferably, the diameter of bottom wall 18 is five feet with the height of the base section 12 being approximately three feet. Preferably, the inside diameter of the upper end of wall 20 is five feet six inches with the outside diameter of the bolt flange 22 being five feet ten inches.

Each of the expander sections 14 comprise a cylindrical wall 28 having a bolt flange 30 at the lower end thereof and a bolt flange 32 at the upper end thereof. The bolt flanges 30 and 32 have openings formed therein adapted to accommodate bolts 26. Preferably, the inside diameter of expander section 14 is five feet six inches with the outside diameter of the bolt flanges being five feet ten inches. Preferably, each of the expander sections 14 has a height of one foot six inches. In most situations, only a single expander section 14 will be utilized although the number of expander sections 14 being utilized will be dependent upon the desired total depth of the shelter.

Top section 16 includes a bolt flange 34 at its lower end and a tapered wall 36 extending upwardly and inwardly therefrom. The upper end of top section 16 is closed except for an access hatch 38 provided therein to enable a person to gain access to the interior of the storm shelter. Hatch 38 is hinged and has a handle/latch 40 provided thereon. Preferably, the outside diameter of flange 34 is five feet ten inches while the inside diameter of wall 36 at the lower end thereof is five feet six inches. Preferably, the inside diameter of the upper end of top section 16 is five feet.

Assuming that the storm shelter 10 is manufactured as a facility remote from the place of installation, the storm shelter 10, by being comprised of components 12, 14 and 16, enables the same to be easily shipped to the installation site. The tapered wall sections of base section 12 and top section 16 enable top section 16 to be inverted and inserted into the open upper end of base section 12 for shipment purposes. Alternatively, base section 12 may be inverted and positioned inside top section 16 through the bottom thereof. The expander section 14 may also be slipped over the wall 20 of base section 12 or the wall 36 of top section 16. Thus, the storm shelter, in its unassembled condition, may be shipped from the factory to the job site.

When the storm shelter arrives at the installation site, a hole may be dug in the ground outside the home 11 with the base section 12 being inserted thereinto. The expander section 14 may then be positioned on the bolt flange 22 of base section 12 with the bolts 26 securing expander section 14 to the base section 12. The top section 16 is then positioned in the hole so that bolt flange 34 rests on bolt flange 32 with bolts 26 being installed in the flanges 32 and 34 to secure the stop section 16 to the expander section 14. Additional expander sections 14 may be installed as required.

Although it has been described that the sections 12, 14 and 16 are bolted together while in the opening in the ground, the sections 12, 14 and 16 could be bolted together prior to being inserted into the ground. Once the shelter 10 is positioned in the ground, earth may be positioned over the upper end of the top section 16 except for the area where the access hatch 38 is located. Alternatively, concrete could be poured over the upper end of the shelter. Further, the shelter 10 may be positioned in the ground beneath the home 11 to enable the residents of the home to gain quick access thereto.

When a storm approaches, access to the interior of the shelter 10 is gained by the person or persons opening access hatch 38. If desired, steps or a ladder 40 may be provided in the interior of the shelter to facilitate entry into the shelter. Once the person or persons are in the shelter, the access hatch 38 is closed.

Thus it can be seen that a novel underground storm shelter has been provided which accomplishes at least all of its stated objectives.

I claim:

1. A storm shelter for placement in the ground, comprising:

an upright hollow member having an open upper end and a closed lower end, with a chamber therebetween said hollow member further having a height and diameter sufficient to permit at least one person to seek shelter therein and comprising:

a base section including a bottom wall and a cylindrical wall extending upwardly therefrom to an upper edge thereof;

a top section secured to said upper edge of said base section and extending upwardly therefrom;

said side wall being tapered and said to section being tapered to enable said base section and said to section to be nested for shipment: and an access cover extending over the open upper end of said chamber for selectively closing said open upper end.

2. The shelter of claim 1 wherein said hollow member is comprised of a plastic member.

3. The shelter of claim 1 wherein said hollow member is comprised of a fiberglass material.

4. The shelter of claim 1 wherein said hollow member is comprised of a concrete material.

5. The shelter of claim 1 wherein a hollow intermediate section is positioned between said base section and said top section.

6. The shelter of claim 1 wherein said bottom section and said top section have registering flanges.

7. The shelter of claim 5 wherein said bottom section, said intermediate section, and said top section have mating flanges.

* * * * *